US007274886B2

(12) United States Patent
Suzuki

(10) Patent No.: US 7,274,886 B2
(45) Date of Patent: Sep. 25, 2007

(54) IMAGE FORMING APPARATUS

(75) Inventor: Nobutaka Suzuki, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 237 days.

(21) Appl. No.: 10/926,182

(22) Filed: Aug. 26, 2004

(65) Prior Publication Data

US 2005/0078973 A1 Apr. 14, 2005

(30) Foreign Application Priority Data

Aug. 26, 2003 (JP) ..... 2003-301275

(51) Int. Cl.
*G03G 15/00* (2006.01)

(52) U.S. Cl. ..... 399/45; 399/389

(58) Field of Classification Search ..... 399/45, 399/389

See application file for complete search history.

(56) References Cited

U.S. PATENT DOCUMENTS

| | | | | |
|---|---|---|---|---|
| 5,335,902 | A | 8/1994 | Suzuki | |
| 6,155,557 | A | 12/2000 | Suzuki | |
| 6,219,498 | B1 * | 4/2001 | Katoh et al. | 399/45 |
| 6,301,452 | B1 * | 10/2001 | Yoshizawa | 399/45 |
| 6,349,932 | B1 | 2/2002 | Suzuki | |
| 2004/0057764 | A1 * | 3/2004 | Jang | 399/389 |

FOREIGN PATENT DOCUMENTS

| | | |
|---|---|---|
| JP | 63-36122 | 2/1988 |
| JP | 7-97099 | 4/1995 |
| JP | 7-196207 | 8/1995 |
| JP | 9-40227 | 2/1997 |
| JP | 9-114267 | 5/1997 |
| JP | 2001-63870 | 3/2001 |
| JP | 2001-139189 | 5/2001 |
| JP | 2003-40486 | 2/2003 |
| JP | 2003-137457 | 5/2003 |

* cited by examiner

*Primary Examiner*—David M. Gray
*Assistant Examiner*—Erika J. Villaluna
(74) *Attorney, Agent, or Firm*—Oblon, Spivak, McClelland, Maier & Neustadt, P.C.

(57) ABSTRACT

An image forming apparatus has a printer engine which forms an image on a medium; a unit which supplies the medium to the engine through a path; an element which emits light onto the medium at a position on the path; a receiving element which receives transmitted light of the light emitted which is transmitted through the medium; another receiving element which receives reflected light of the light emitted which is reflected by the medium; a unit which executes a detection through the emission and reception; a unit which determines a characteristic of the medium based on detection signals output by the receiving elements as a result of the detection; and a control unit which executes a control in the apparatus based on the characteristic.

9 Claims, 9 Drawing Sheets

FIG.9
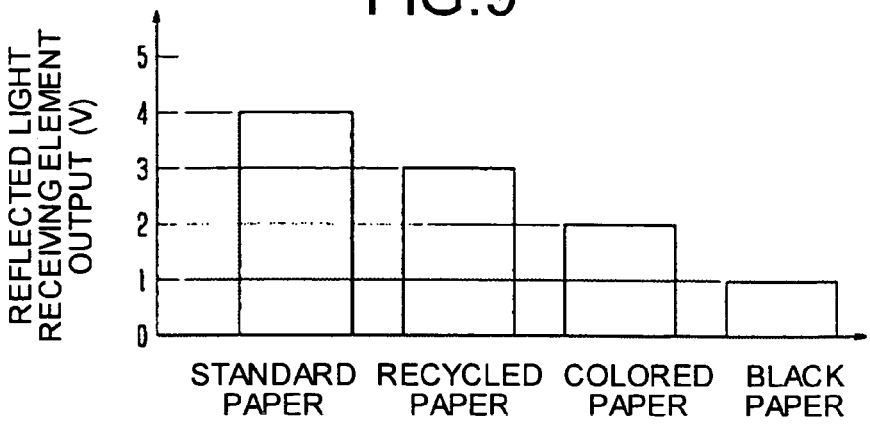
FIG.10
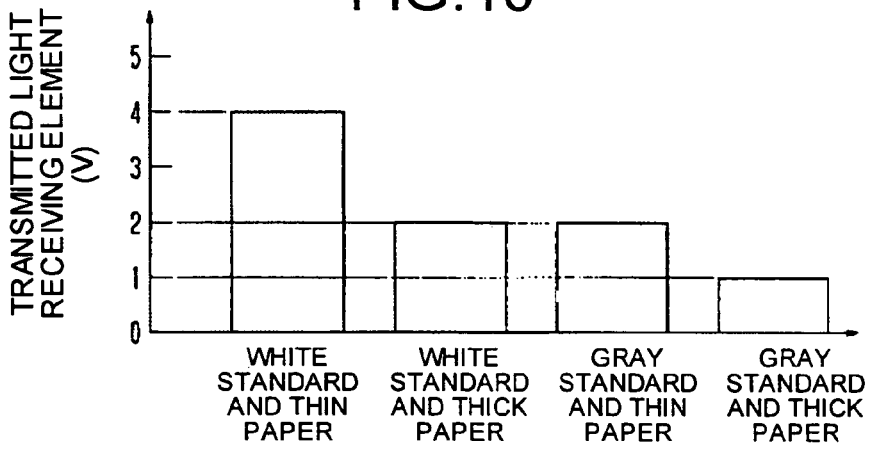
FIG.11
| | TRANSMITTED LIGHT RECEIVING ELEMENT OUTPUT (V) | | REFLECTED LIGHT RECEIVING ELEMENT OUTPUT (V) |
|---|---|---|---|
| | THIN PAPER | THICK PAPER | |
| WHITE | 4V | 2V | 4V |
| GRAY | 2V | 1V | 2V |

FIG.12
| | OPERATION OF TRANSMITTED LIGHT RECEIVING ELEMENT OUTPUT (V) | | REFLECTED LIGHT RECEIVING ELEMENT OUTPUT (REFERENCE VOLTAGE; 4V) |
|---|---|---|---|
| | THIN PAPER | THICK PAPER | |
| WHITE | 4V/(4/4)=4V | 2V/(4/4)=2V | 4V |
| GRAY | 2V/(2/4)=4V | 1V/(2/4)=2V | 2V |
FIG.13
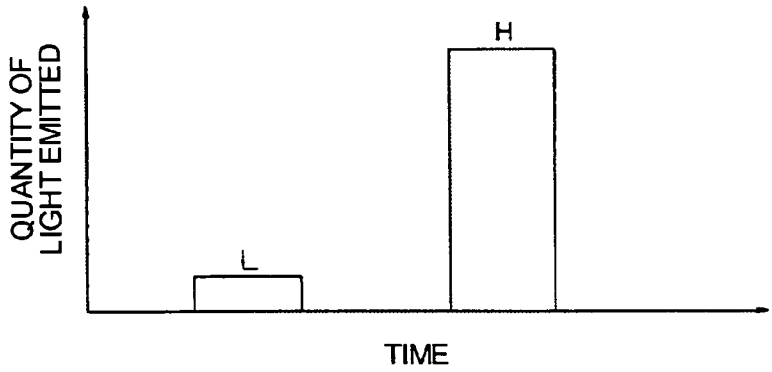
FIG.14
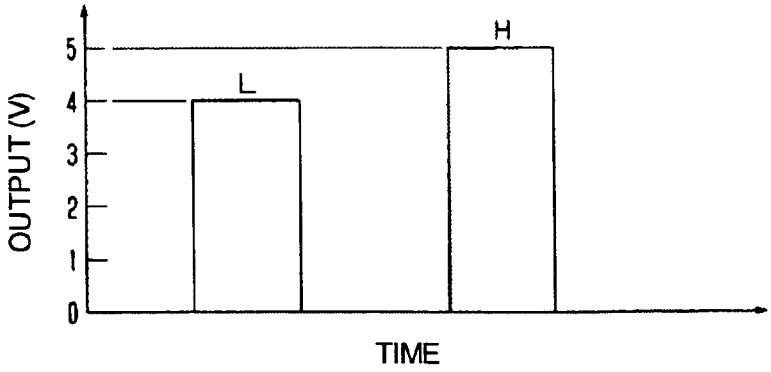

IMAGE FORMING APPARATUS

CROSS-REFERENCE TO RELATED APPLICATIONS

The present document incorporates by reference the entire contents of Japanese priority document, 2003-301275 filed in Japan on Aug. 26, 2003.

BACKGROUND OF THE INVENTION

1) Field of the Invention

The present invention relates to an image forming apparatus that forms an image on a medium such as paper.

2) Description of the Related Art

Japanese Patent Application Laid-Open No. 07-196207 discloses a technique for allowing an optical projector and an optical receiver which form an optical axis that crosses a print paper drawn out from a paper feed tray to detect a quantity of light transmitted through the print paper, converting the detected quantity of transmitted light into a corresponding voltage, comparing the voltage corresponding to the quantity of transmitted light with a predetermined threshold, and determining a type of the print paper. The determination result is then transmitted to a host computer.

Japanese Patent Application Laid-Open No. 09-114267 discloses an image forming apparatus capable of transferring a recorded image onto a recording target material by developing an electrostatic latent image, which the apparatus includes a paper type detecting unit that optically detects characteristics related to a paper quality of the recording target material based on a spectral reflectance, and a control unit that controls transfer of the recorded image according to the detection result of the paper type detecting unit.

Recently, demands for improving an image quality and simplifying operation are increasing for image forming apparatuses. For example, an electrophotographic apparatus is intended to improve image quality by changing a transfer current carried to a transfer device that transfers an image (a toner image) onto paper according to a paper thickness or by changing a temperature of a fixing device. In order to improve the image quality, it is required to strictly control the transfer device, the fixing device, and the like according to information on characteristics of the paper such as a thickness and a color of the paper. Settings of these devices for control, however, all rely on user's manual input.

Nevertheless, in offices, shops, or the like where the image forming apparatus includes multiple tiers of paper feed trays and many unspecified users use various types of paper for the apparatus, the users are reluctant to make such settings as it is complicated, and some users do not know how to handle or how to use the apparatus. Therefore, improvements on image quality cannot be attained in the end.

If the image forming apparatus automatically determines the thickness and the color of the paper as disclosed in the Laid-Open Japanese Patent Applications, the transfer device, the fixing device, and the like can be controlled based on the information on the paper thickness and color.

The techniques disclosed in the Laid-Open Japanese Patent Applications are, however, confronted with the following disadvantages. With each of the conventional techniques, the apparatus can identify only specific items and cannot detect the characteristics of the paper which can be recognized only after two pieces of information, i.e., transmittance and reflectance are detected. As a result, a disadvantage that the transfer device, the fixing device, and the like cannot be controlled based on these pieces of information occurs to the apparatus. Examples of the paper characteristics that can be recognized after the transmittance and reflectance of the paper are detected include a thickness of a colored paper. For example, if the paper color is white only, the thickness of the paper can be determined from the transmittance of the paper. However, if the paper is one of light brown or the other color such as a recycled paper or a colored paper, the paper is lower in transmittance than the white paper even with an equal thickness. As a result, the apparatus erroneously determines the thickness of the paper as thicker than the actual thickness. If not only the transmittance but also reflectance are measured simultaneously, information on the color of the paper can be acquired and the apparatus can, therefore, measure the thickness of the recycled paper or the colored paper as accurately as that of the white paper.

SUMMARY OF THE INVENTION

It is an object of the present invention to solve at least the problems in the conventional technology.

An image forming apparatus according to an aspect of the present invention includes a printer engine configured to form an image on a medium; a supply unit configured to supply the medium to the printer engine through a feed path; a light emitting element configured to emit light onto the medium at a predetermined position on the feed path; a transmitted light receiving element configured to receive transmitted light of the light emitted by the light emitting element which is transmitted through the medium; a reflected light receiving element configured to receive reflected light of the light emitted by the light emitting element which is reflected by the medium; a detecting unit which executes a detection through the emission of light and the reception of transmitted light and reflected light; a first determining unit which determines a characteristic of the medium based on detection signals output by the transmitted light receiving element and the reflected light receiving element as a result of the detection; and a control unit which executes a predetermined control in the image forming apparatus based on the characteristic determined by the first determining unit.

The other objects, features, and advantages of the present invention are specifically set forth in or will become apparent from the following detailed description of the invention when read in conjunction with the accompanying drawings.

BRIEF DESCRIPTION OF THE DRAWINGS

FIG. 9 is a graph of the output of the reflected light receiving element depending on a thickness of the paper;

FIG. 10 is a graph of the output of the transmitted light receiving element depending on a color and a thickness of the paper;

FIG. 11 is an explanatory view which depicts examples of the outputs of the transmitted light receiving element and the reflected light receiving element;

FIG. 12 is an explanatory view which depicts examples of the outputs of the transmitted light receiving element and the reflected light receiving element;

FIG. 13 is a graph of a quantity of the light emitted from the light emitting element at time series;

FIG. 14 is a graph of the output of the transmitted light receiving element when the paper is not present;

DETAILED DESCRIPTION

Exemplary embodiments of the present invention are explained in detail below with reference to the accompanying drawings.

Figure 1:
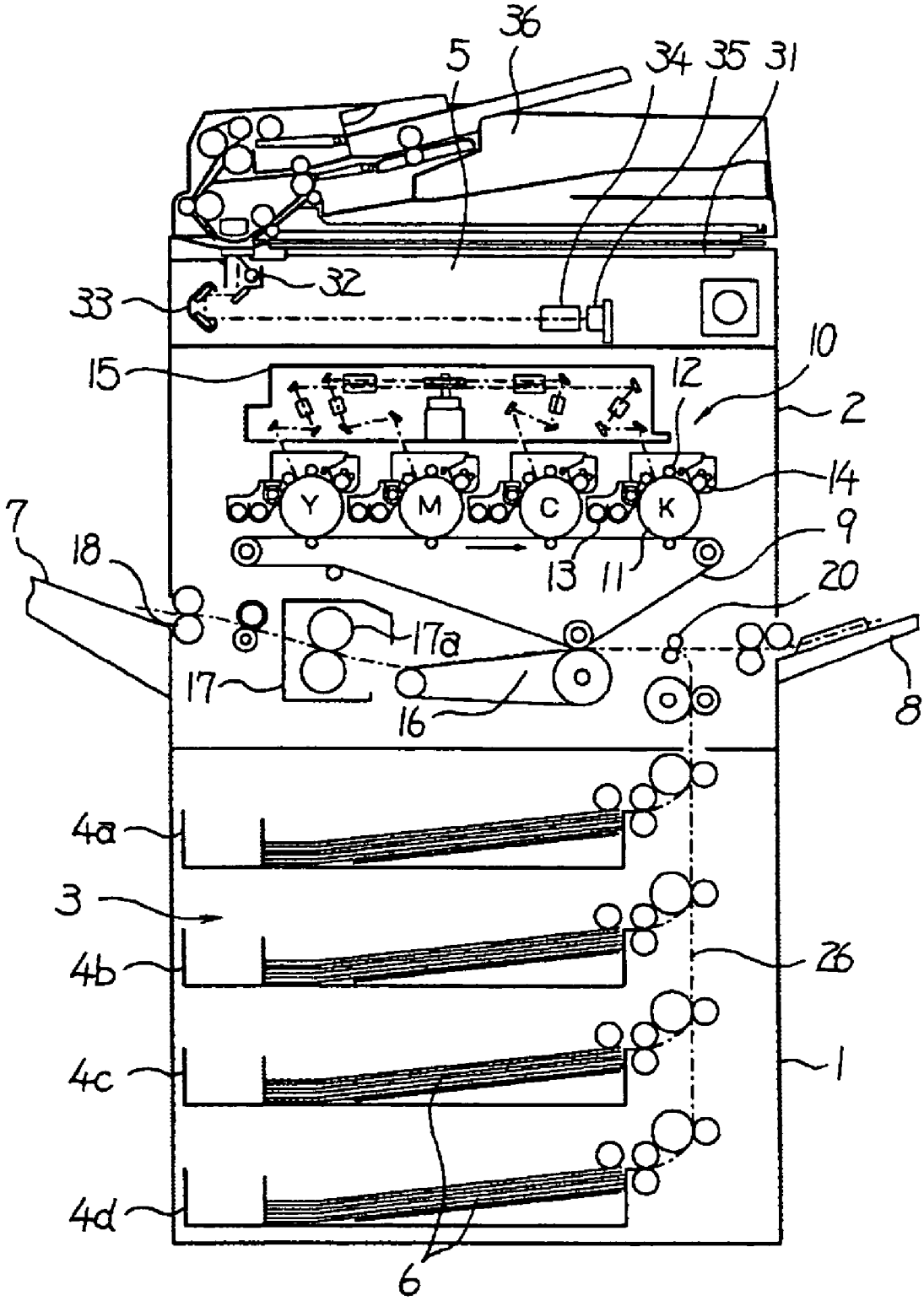
FIG. 1 is a longitudinal front view of the schematic configuration of an image forming apparatus according to one embodiment of the present invention.

An instance in which a tandem-type full color image forming apparatus using electrophotography is used as an image forming apparatus according to the embodiment of the present invention will be explained herein. FIG. 1 is a longitudinal front view of the overall schematic configuration of the full color image forming apparatus. In an apparatus main unit 1, an image forming unit (a printer engine) 2 is provided generally at a center, and a paper feed unit 3 serving as a paper feeder is arranged just under the image forming unit 2. The paper feed unit (paper supply unit) 3 includes paper feed cassettes 4*a* to 4*d* of four-tier, each serving as, for example, a paper storage unit. The paper feed units 4*a* to 4*d* are provided to be freely pulled out from and contained in the apparatus main unit in a longitudinal direction (a direction from a front surface to a rear surface of paper in FIG. 1). A reader unit (a scanner) 5 that reads an image of an original is provided above the image forming unit 2. A paper discharge tray 7 to which an image-formed paper 6 is discharged is provided downstream (leftward in FIG. 1) of a paper feed direction of the image forming unit 2. A manual feed tray 8 which serves as a paper container unit that manually feeds the paper 6 is provided upstream of the paper feed direction of the image forming unit 2.

In the image forming unit 2, a plurality of imaging unit 10 for yellow (Y), magenta (M), cyan (C), and black (K) are arranged in parallel over an intermediate transfer belt 9 composed by an endless belt. In each imaging unit 10, electrophotographic process members or devices such as a charging device 12, an exposure unit, a developer 13, and a cleaning device 14 are arranged along an outer periphery of each of drum-shaped photosensitive bodies 11 provided to correspond to the respective colors. The charging device 12 charges a surface of the corresponding photoconductor 11. The exposure unit irradiates a laser light from an exposure device 15 for forming image information onto the surface of the photoconductor 11. The developer 13 develops an electrostatic latent image formed on the surface of the photoconductor 11 by light exposure using toners, and visualizes the image. The cleaning device 14 removes and collects the toners remaining on the surface of the photoconductor 11 after transfer.

An imaging process is as follows. An image per color is formed on the intermediate transfer belt 9 and images in four colors are superimposed on the intermediate transfer belt 9, thereby forming one color image. Specifically, the yellow (Y) imaging unit develops an electrostatic latent image with a yellow (Y) toner and transfers the developed image onto the intermediate transfer belt 9. The magenta (M) imaging unit develops the electrostatic latent image with a magenta (M) toner and transfers the developed image onto the intermediate transfer belt 9. The cyan (C) imaging unit develops the electrostatic latent image with a cyan (C) toner and transfers the developed image onto the intermediate transfer belt 9. Finally, the black (K) imaging unit develops the electrostatic latent image with a black (K) toner and transfers the developed image onto the intermediate transfer belt 9. As a result, a full color toner image having four colors superimposed is formed. The four-color toner image is transferred onto the paper 6 fed from the paper feed unit 3 by a transfer device 16, fixed onto the paper 6 by a fixing device 17, and discharged to the paper discharge tray 7 by paper discharge rollers 18. The toners remaining on the intermediate transfer belt 9 are removed and collected by a cleaning device 21.

A feed path 26 connects the respective paper feed trays 4*a* to 4*d*, the manual feed tray 8, and resist rollers 20 to one another. The paper 6 fed from an arbitrary paper feed location is fed to the resist rollers 20 through the feed path 26. The resist rollers 20 temporarily stops feeding the paper 6, and feeds the paper 6 again at an appropriate timing so that the toner image on the intermediate transfer belt 9 and a tip end of the paper 6 have a predetermined positional relationship. The resist rollers 20 function similarly for the paper 6 fed from the manual feed tray 8.

In the reader unit 5, a first traveling unit 32 and a second traveling unit 33 each equipped with an original illuminating light source and a mirror reciprocate so as to read and scan an original (not shown) mounted on a contact glass 31. Image information read and scanned by the traveling bodies 32 and 33 is collected on an image forming surface of a charge coupled device (CCD) 35 disposed in rear of a lens 34, and read as an image signal by the CCD 35. This read image signal is converted into a digital signal and subjected to an image processing. The image-processed signal is optically written onto the surface of the photoconductor 11 by a light emitted from a laser diode LD (not shown) provided within the exposure device 15, thereby forming an electrostatic latent image. An optical signal from the LD reaches the photoconductor 11 through a well-known polygon mirror and a lens. Further, an automatic original feeding device 36 that automatically feeds the original onto the contact glass 31 is provided above the reader unit 5.

The full color image forming apparatus according to this embodiment is a multifunction image forming apparatus or multifunction product (MFP). Namely, the full color image forming apparatus functions as a so-called digital full color copier which reads the original by optical scan, coverts the image signal into the digital signal, and duplicates the original. In addition, the full color image forming apparatus functions as a facsimile machine which transmits and receives image information on the original to and from a counterpart machine at a remote location by a controller (not shown). Further, the full color image forming apparatus functions as a printer which prints the image information processed by a computer on the paper. The image formed by any function is formed on the paper 6 by a similar image formation process, and the resultant paper 6 is discharged to the paper discharge tray 7 and contained.

Figure 2A:
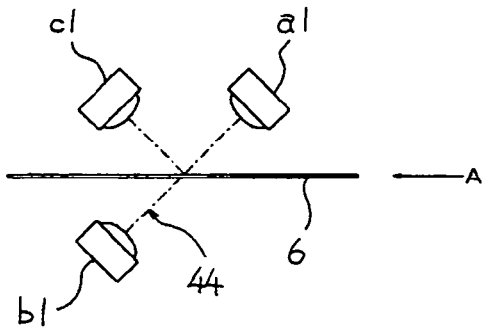
FIGS. 2A and 2B are explanatory views which depict examples of arrangement of a light emitting element, a transmitted light receiving element, and a reflected light receiving element.
Figure 2B:
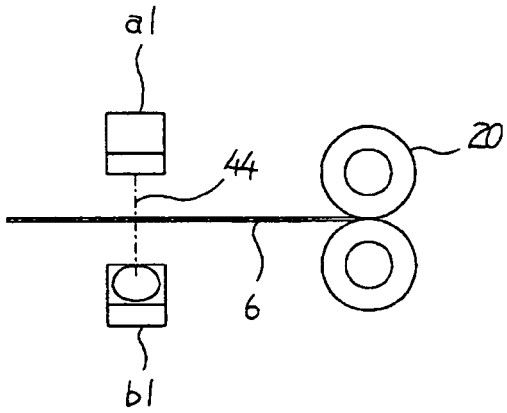
Figure 3:
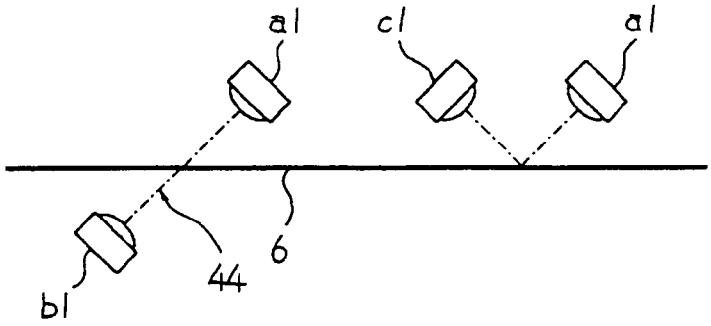
FIG. 3 is an explanatory view which depicts another example of the arrangement of light emitting elements, the transmitted light receiving element, and the reflected light receiving element.

As shown in FIGS. 2A and 2B, a light emitting element a1 which emits a light to the paper 6 and a transmitted light receiving element b1 which receives a light transmitted through the paper 6 are provided at arbitrary positions on the feed path 26 which feeds the paper 6 from the paper feed unit 3 to the imaging unit (printer engine) 10, that is, just in front of the resist rollers 23 in this embodiment, in a positional relationship that the paper 6 is held between the light emitting element a1 and the transmitted light receiving element b1. In addition, a reflected light receiving element c1 is provided at a position at which the element c1 can receive a light reflected by the paper 6 of the light emitted by the light emitting element a1. FIG. 2B is a view which depicts FIG. 2A from an arrow A direction. As shown in FIG. 3, two or more light emitting elements a1 may be prepared so as to separately provide light sources of the light received by the transmitted light receiving element b1 and the light received by the reflected light receiving element c1, respectively.

The light emitting element a1 may be a white light, an LED, a laser, or the like. The light emitted by the light emitting element a1 may be an arbitrary light such as a visible light, an infrared light, or an ultraviolet light. The transmitted light receiving element b1 and the reflected light receiving element c1 may be photo-transistors, photodiodes, or the like. Detection signals of voltages, currents, or the like are output to a control unit 41 (explained later).

Figure 4:
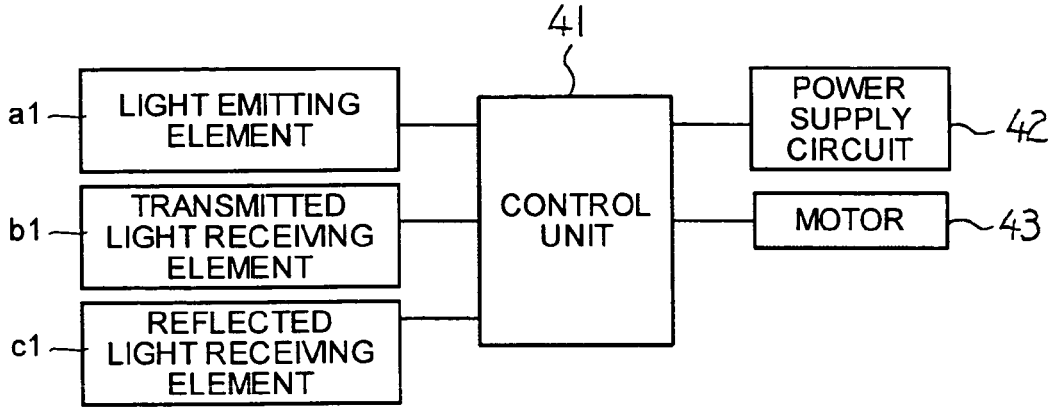
FIG. 4 is a block diagram of electric connection of the image forming apparatus.

FIG. 4 is a block diagram of a control system which controls an image forming operation performed by the imaging unit 10. This control system is constituted to be centered around the control unit 41. The control unit 41 includes a microcomputer, and various actuators and sensors for controlling the image forming operation are connected to the control unit 41 (as shown in FIG. 4 in detail, although not explained herein). Among others, a power supply circuit 42 and a motor 43 are connected to the control unit 41 through predetermined interfaces. The power supply circuit 42 supplies a power to the light emitting element a1, the transmitted light receiving element b1, the reflected light receiving element c1, a heater which heats the fixing rollers 17*a* of the fixing device 17 (see FIG. 1), and the transfer device 16. The motor 43 serves as an actuator for feeding the paper 6 on the feed path 26.

Figure 5:
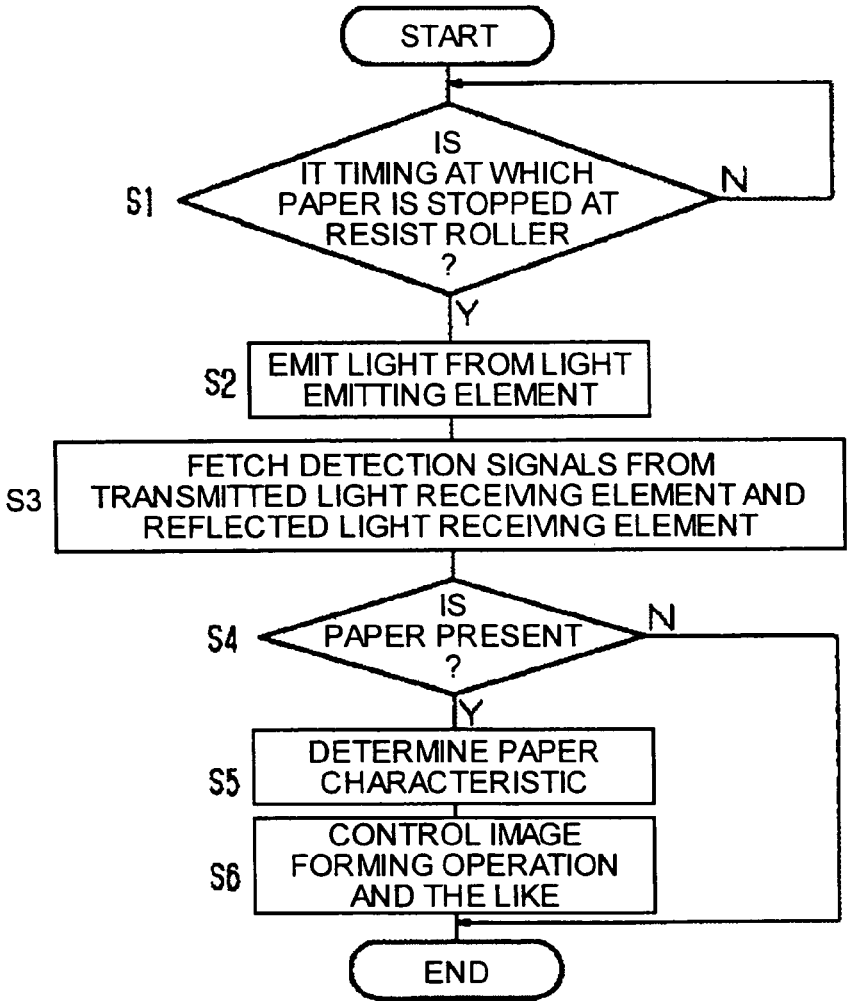
FIG. 5 is a flowchart which explains an operation of the image forming apparatus.

FIG. 5 is a flowchart which depicts an outline of one example of a control processing executed by the control system shown in FIG. 4. If the imaging unit 10 executes the image forming operation, the paper 6 is fed from the paper feed unit 3 and contacted on the resist rollers 20. At a timing at which the paper 6 is stopped at the resist rollers 20 ("Y" at a step S1), a central processing unit (CPU) of the control unit 41 shown in FIG. 4 lets the light emitting element a1 emit a light (a detecting unit) (at a step S2). The transmitted light receiving element b1 receives the light that is transmitted through the paper 6 and that is attenuated and outputs a detection signal (the detecting unit). At the same time, the reflected light receiving element c1 receives the light that is reflected by a surface of the paper 6 and outputs a detection signal (the detecting unit). The central processing unit (CPU) of the control unit 41 shown in FIG. 4 fetches the respective detection signals (the detecting unit) (at a step S3). Based on the detection signals, it is determined whether the paper 6 is present (a second determining unit) (at a step S4). If the paper 6 is present ("Y" at the step S4), the characteristics of the paper 6 such as the thickness and the color of the paper 6 are determined (a first determining unit) (at a step S5). Based on a determination result, the CPU controls a series of image forming operations and the like performed by the image forming apparatus (a control unit) (at a step S6). Specifically, the CPU controls the power supply circuit 42 and the motor 43. More specifically, the CPU exercises control so that the toner image can be fixed onto the paper 6 at an appropriate temperature after the toner image is formed, so that a transfer current of the transfer device 16 can be set appropriately, and so that a speed of the motor 43 for feeding the paper 6 can be set appropriately. It is noted that the light emitting element a1 may emit the light while the paper 6 is being fed.

If the paper 6 is thick, heat is taken away by the paper 6 itself. It is, therefore, necessary to set a temperature of the heater of the fixing device 17 which fixes the image (toner image) onto the paper 6 to be higher than that for a thin paper. In addition, an optimum transfer current of the transfer device 16 which transfers the image onto the paper 6 differs according to the thickness of the paper 6. Further, if the paper 6 is an overhead projector (OHP) paper, colors do not come well when the image is projected by an overhead projector unless the image is transferred onto the OHP paper at a higher density than that of a standard paper. Therefore, toner quantities are increased by setting a paper feed speed for the OHP paper lower than that for the standard paper. These settings are normally made by the user on an operation panel (not shown) or a personal computer.

In the control processing shown in FIG. 5, the characteristics of the paper (medium) 6 such as the thickness, the type, and the color of the paper 6 can be detected. This, therefore, makes it possible to automatically set a control over the transfer current of the transfer device 6, that over the temperature of the fixing device 17, that over the speed for feeding the paper 6, and the like.

Instead of the control processing at the step S6, the control system may execute a control so that the characteristics of the paper 6 such as the thickness and the type are notified to the operation panel or a host computer (not shown) connected to the apparatus main unit 1, or may execute a control so as to give an alarm by a lamp or a buzzer. The user can be thereby notified of the control and manually set the characteristics of the paper 6.

A specific content of the control processing which can be executed by the control unit 41 at the steps S2 to S4 or the like will be explained in detail.

Figure 6:
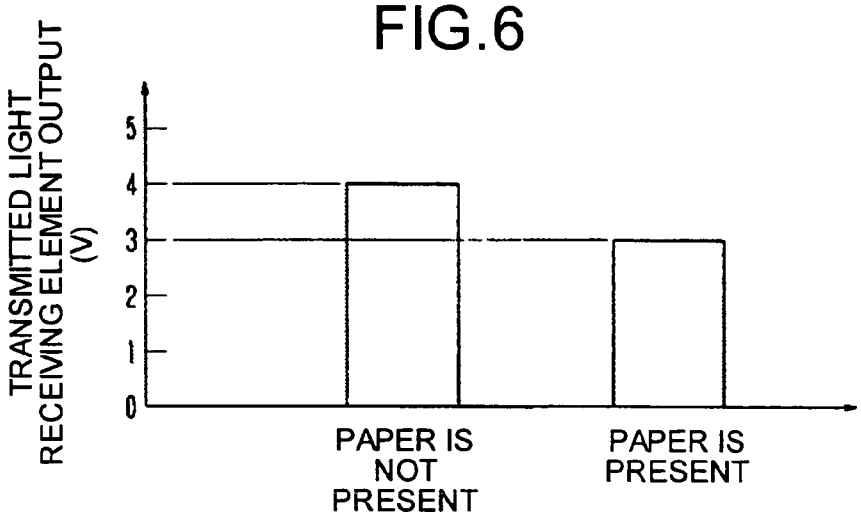
FIG. 6 is a graph of an output of the transmitted light receiving element depending on presence of paper.

FIG. 6 is a graph of levels of the detection signal output from the transmitted light receiving element b1 when the paper 6 is present and when the paper 6 is not present, respectively. The light emitting element a1 emits the light controlled to have an arbitrary intensity by digital-to-analog (D/A) conversion before arrival of the paper 6. The transmitted light receiving element b1 outputs a constant output (a voltage of 4 volts in this embodiment) to the control unit 41. When the paper 6 intercepts an optical axis 44, the light is attenuated and the output of the transmitted light receiving element b1 is reduced (to 3 volts in this embodiment). The control unit 41 can determine that the paper 6 is present at the step S4 or the like (the second determining unit).

Figure 7:
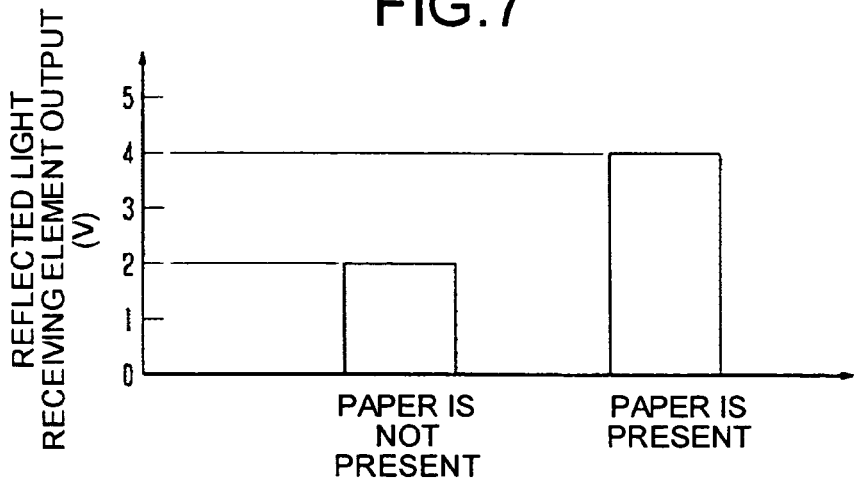
FIG. 7 is a graph of an output of the reflected light receiving element depending on presence of paper.

The light emitting element a1 emits the light controlled to have the arbitrary intensity by the D/A conversion before arrival of the paper 6, and the reflected light receiving element c1 outputs a constant output (a voltage of 2 volts in this embodiment) to the control unit 41. As shown in FIG. 7, when the light is reflected by the paper 6, a quantity of the received light of the reflected light receiving element c1 is increased and the output of the reflected light receiving element c1 is increased (to 4 volts in this embodiment), accordingly. Therefore, the control unit 41 can determine that the paper 6 is present.

Figure 8:
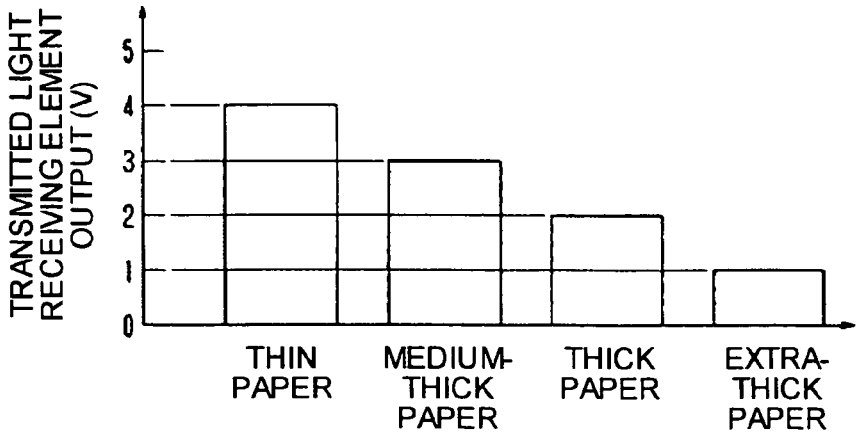
FIG. 8 is a graph of the output of the transmitted light receiving element depending on a thickness of the paper.

Based on the detection signal output from the transmitted light receiving element b1, the control unit 41 can determine the transmittance of the paper 6. As shown in FIG. 8, the control unit 41 can determine the thickness of the paper 6, i.e., if the transmittance is high, the control unit 41 can determine that the paper 6 is thin, and if low, the control unit 41 can determine that the paper 6 is thick. Specifically, the light emitting element a1 emits the light controlled to have the arbitrary intensity by the D/A conversion. It is assumed that if the paper 6 is a thick standard paper, the output of the transmitted light receiving element b1 is 4 volts. If so, the output is 3 volts for a medium thick paper, 2 volts for a thick paper, and 1 volt for an extra thick paper. It is noted that these numeric values (voltages) shown in FIG. 8 are only an example.

The reflected light receiving element c1 can detect the reflectance of the paper 6. This is because the reflectance of the paper 6 having a high whiteness level is high and that of the paper 6 having a low whiteness level such as a recycled paper or a colored paper is low. Specifically, the light emitting element a1 emits the light controlled to have the arbitrary intensity by the D/A conversion. It is assumed that if the paper 6 is a white standard paper, the output of the reflected light receiving element c1 is 4 volts. If so, as shown in FIG. 9, the output is 3 volts for the recycled paper having the low whiteness level, 2 volts for the colored paper, and 1 volt for a black paper. Similarly to those shown in FIG. 8, the numeric values (voltages) shown in FIG. 9 are only an example.

The light emitted by the light emitting element a1 is not necessarily the visible light. Even if the light is not the visible light but the infrared light or the ultraviolet light, characteristics that a white tends to reflect the light and that a black tends to absorb the light are applied to the light.

Furthermore, the light emitted by the light emitting element a1 may be a white light (a natural light) so that color information such as red, green, or blue can be detected. Specifically, a color CCD may be used as the reflected light receiving element c1, and a plurality of reflected light receiving elements c1 including filters such as red, green and blue, respectively may be arranged.

As explained above, the thickness of the paper 6 can be detected based on the transmittance of the paper 6 detected by the transmitted light receiving element b1. However, the light brown recycled paper or colored paper is lower in transmittance than the white paper. Therefore, even with the equal thickness, it is erroneously determined the thickness of such paper thicker than the actual thickness. It is assumed, for example, that the output of the reflected light receiving element b1 is 4 volts for a white thin standard paper and 2 volts for a white thick paper. If so, the output is 2 volts for a gray thin standard paper, and 1 volt for a gray thick paper (see FIG. 10).

Nevertheless, since the output of the reflected light receiving element c1 is 4 volts for the white thin or thick paper and 2 volts for the gray thin or thick paper, the color of the paper can be determined (see FIG. 11). Since the reflected light is not affected by the thickness of paper, there is no difference between the outputs of the reflected light receiving element c1 for thin and thick papers. Therefore, the control unit 41 can accurately determine the thickness of the paper 6 using not only the output of the transmitted light receiving element b1 but also the output of the reflected light receiving element c1, irrespective of the color of the paper 6 (the first determining unit). Specifically, a data table registered in a read only memory (ROM) of the control unit 41 and used to calculate the thickness of the paper 6 may be changed from the data table for the white paper to that for the gray paper. Alternatively, color information may be incorporated in thickness calculation. For example, if the thickness of the paper 6 is determined by the calculation, then the output of 4 volts of the reflected light receiving element c1 is set as a reference value, and the output of the transmitted light receiving element b1 is divided by a ratio (of the output of the reflected light receiving element c1) to the reference 4 volts (see FIG. 12). Specifically, if the output of the reflected light receiving element c1 is 2 volts, the output of the transmitted light receiving element b1 I divided by "2/4=0.5". Therefore, for the gray thin paper, the output of the transmitted light receiving element b1 is "2V/0.5=4V". For the gray thick paper, the output of the transmitted light receiving element b1 is "1V/0.5=2V". Whether the paper color is white or gray or the other color, the output of the transmitted light receiving element b1 is 4 volts for the thin paper and 2 volts for the thick paper. Similarly to those shown in FIGS. 8 and 9, the numeric values (voltages) are only an example for convenience of explanation.

FIG. 13 is a graph of a quantity of the emitted light emitted from the light emitting element a1 at time series. The light emitting element a1 emits a weak light (L) first, and emits a strong light (H) next. It is assumed herein that the strong light H is 50 times higher in intensity than the weak light L. A magnitude order of this pulse light emission may be arbitrarily set. FIG. 14 is a graph of the output of the transmitted light receiving element b1 when the element b1 receives the lights shown in FIG. 13 and the paper 6 is not present. In this example, the output of the transmitted light receiving element b1 for the weak light L is 4 volts and that for the strong light H is 5 volts. If the light emitting element a1 emits a light which is 1.1 times higher in intensity than the weak light L, the output of the transmitted light receiving element b1 for the weak light L is "4×1.1=4.4V". The output of the transmitted light receiving element b1 for the strong light H is 5 volts, which is an output limit (a saturated output) of the transmitted light receiving element b1. Therefore, even if the transmitted light receiving element b1 receives a light stronger than the strong light H, the output of the element b1 remains 5 volts.

Figure 15:
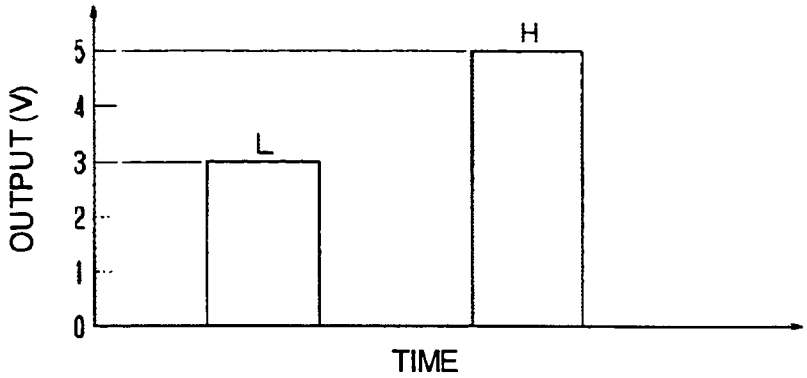
FIG. 15 is a graph of the output of the transmitted light receiving element when the paper having a high transmittance is used.

FIG. 15 is a graph of the output of the transmitted light receiving element b1 when the element b1 receives the lights shown in FIG. 13 and transmitted through the paper 6 having a high transmittance (e.g., the OHP paper). The output of the transmitted light receiving element b1 for the weak light L is 3 volts and that for the strong light L is 5 volts. The output of the transmitted light receiving element b1 for the weak light L is 4 volts when the paper 6 is not present and 3 volts when the light is transmitted through the paper 6 having the high transmittance. The control unit 41 can, therefore, determine that the transmittance of the paper 6 at this time is "(3/4)×100=75%". On the other hand, since the output of the transmitted light receiving element b1 for the strong light H is 5 volts whether the paper 6 is present or not present, the control unit 41 cannot determine the transmittance of the paper 6.

Figure 16:
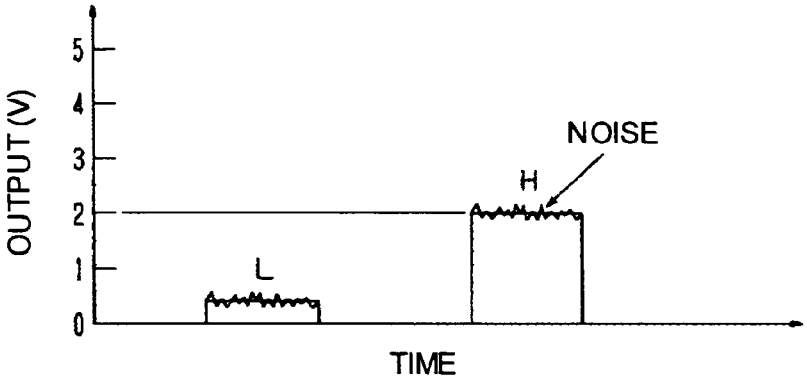
FIG. 16 is a graph of the output of the transmitted light receiving element when the paper having a low transmittance is used.

FIG. 16 is a graph of the output of the transmitted light receiving element b1 when the element b1 receives the lights shown in FIG. 13 and transmitted through the paper 6 having a low transmittance (e.g., the thick paper). The output of the transmitted light receiving element b1 for the weak light L is 0.04 volt, and that for the strong light H is 2 volts. The output of the transmitted light receiving element b1 for the weak light L is 4 volts when the paper 6 is not present, and that for the weak light transmitted through the paper 6 having the low transmittance is 0.04 volt. Therefore, the control unit 41 can determine that the transmittance of the paper 6 at this time is "$(0.04/4)\times100=1\%$". In addition, the strong light H is 50 times higher in intensity than the weak light L. Therefore, the control unit 41 can also determine from the output of 2 volts of the transmitted light receiving element b1 for the strong light H that the transmittance of the paper 6 at this time is "$(2/4)\times50)\times100=1\%$". However, if it is assumed that a noise of ±0.04V is carried over each of the weak light L and the strong light H, then the output of the transmitted light receiving element b1 for the weak light L is 0.04±0.04V, and the transmittance of the paper 6 is, therefore, zero to 2%. On the other hand, the output of the transmitted light receiving element b1 for the strong light H is 2±0.04V, an error is "$\pm(0.04/4\times50)\times100=\pm0.02\%$", and the transmittance light of the paper 6 including the error is, therefore, 0.08 to 1.02%. The accuracy of the transmitted light receiving element b1 for the strong light H is improved from that for the weak light L.

In the examples of FIGS. 13 to 16, two types of lights, strong and weak lights are emitted to the same paper 6. However, as long as the transmittance of the paper 6 is roughly known in advance, it suffices to emit a light having an intensity suited for the transmittance of the paper 6 to the paper 6 only once. Specifically, many copiers have such specifications that sheets of the standard paper can be fed only from the paper feed trays 4*a* to 4*d* (see FIG. 1), and that sheets of a special paper such as the OHP paper can be fed only from the manual feed tray 8 (see FIG. 1). Therefore, it may be considered that only the strong light may be emitted to each paper 6 fed from the paper feed trays 4*a* to 4*d*.

For the weak light L as explained with reference to FIGS. 13 to 16, the output of the transmitted light receiving element b1 when the paper 6 is not present is 4 volts. Therefore, if the output is changed to 3.9 volts due to, for example, a temperature change, the light emission quantity of the light emitting element a1 may be increased.

For the strong light H, by contrast, the output of the transmitted light receiving element b1 when the paper 6 is not present is 5 volts which reaches the output limit (saturated output). Therefore, it is unknown whether the light emission quantity is deviated from a specified output because of the temperature change.

Figure 17:
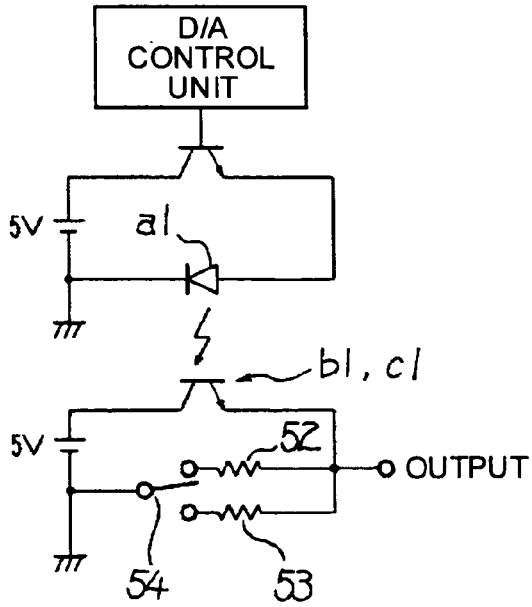
FIG. 17 is a circuit diagram of a correction dedicated output circuit.

To deal with such a situation, a correction dedicated output circuit 51 may be provided for the transmitted light receiving element b1 so as to be able to obtain the output of the transmitted light receiving element b1 at a low constant ratio even if the output of the light emitting element a1 is changed due to an environmental change such as the temperature change (a correcting unit) (see FIG. 17). Specifically, it is assumed that an output resistance 52 of the transmitted light receiving element b1 is 50 kilo ohms during ordinary detection of the characteristics of the paper 6 by the transmitted light receiving element b1 and the reflected light receiving element c1. If so, an output resistance 53 of 1 kilo ohm is prepared separately from the output resistance 52. The control unit 41 changes over a switch 54 so as to be able to select one of the output resistances 52 and 53 as the output resistance of the transmitted light receiving element b1. During correction, the output resistance 53 of 1 kilo ohm is selected, whereby the output of the transmitted light receiving element b1 when using the output resistance 53 is 1/50 of that when using the output resistance 52. It is, therefore, possible to correct the light emission quantity of the light emitting element a1 similarly to an instance in which the element a 1 emits the weak light L (assuming that the strong light H is 50 times higher in intensity than the weak light L).

Likewise, the similar output circuit 51 may be provided for the reflected light receiving element b1 so as to be able to obtain the output of the reflected light receiving element b1 at a low constant ratio even if the output of the light emitting element a1 is changed due to the environmental change such as the temperature change (the correcting unit).

Figure 18A:
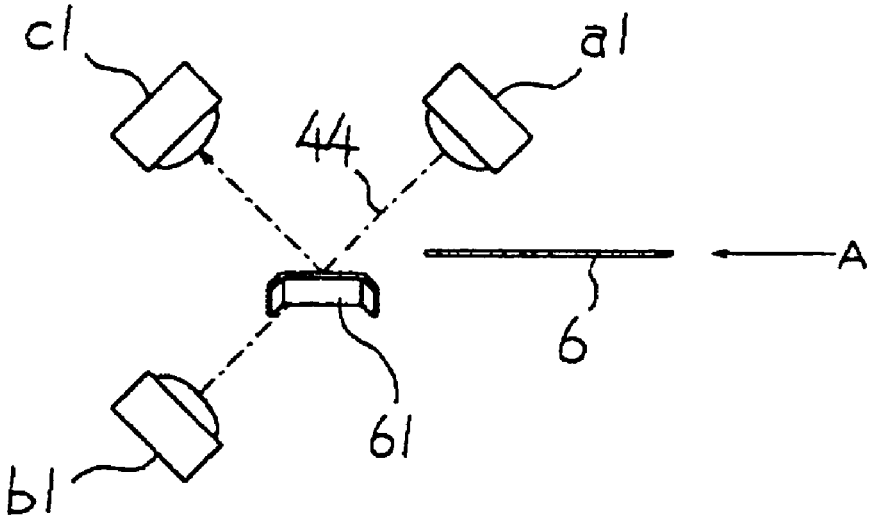
FIGS. 18A and 18B are explanatory views for a light guide member using a reflecting material.

As a member that causes the light emitted from the light emitting element a1 to be incident on the reflected light emitting element c1 when the paper 6 is not on the optical axis 44, a light guide member 61 that reflects the light from the light emitting element a1 may be arranged at an arbitrary position as shown in FIG. 18. A material for the light guide member 61 is preferably a mirror or a metal plate; however, resin, paper, or the like may be used as the material for the light guide member 61. A color of the light guide member 61 is preferably as close as white.

Figure 18B:
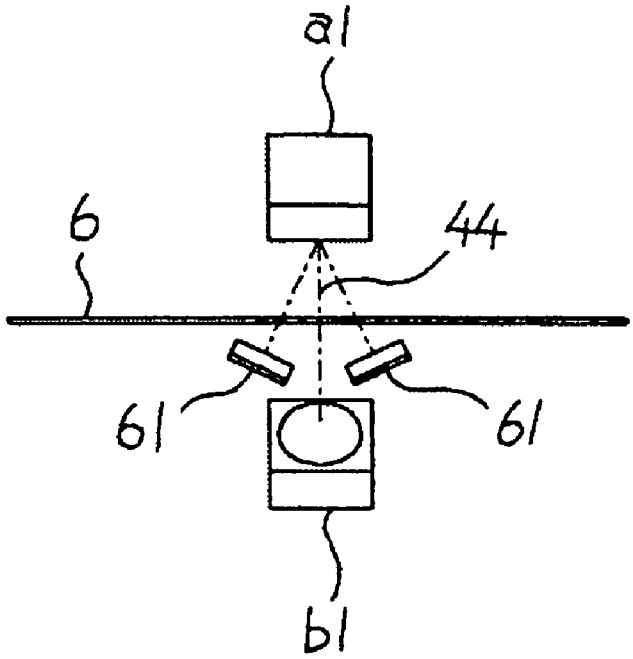
Figure 19A:
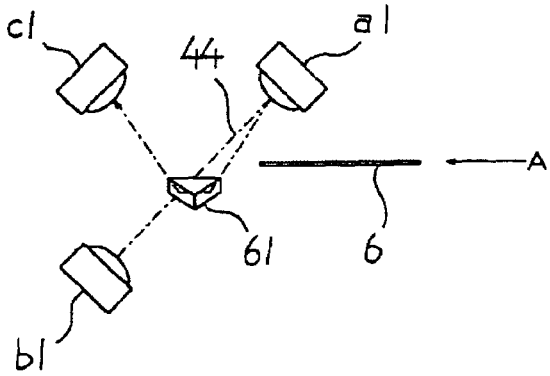
FIGS. 19A and 19B are explanatory views for a light guide member using a prism.
Figure 19B:
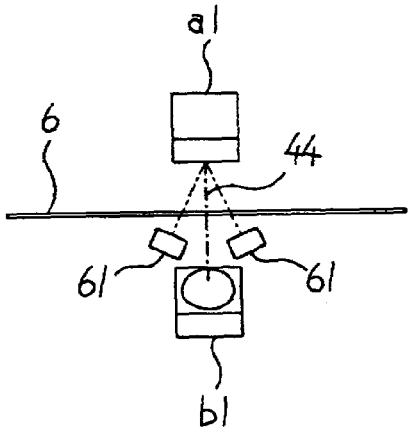
Figure 20:
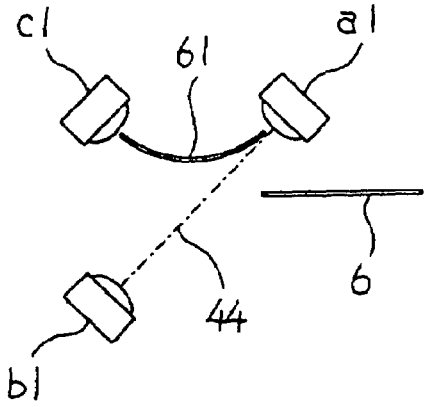
FIG. 20 is an explanatory view for a light guide member using an optical fiber.

Further, a prism may be employed as the light guide member 61 as shown in FIGS. 19A and 19B, or an optical fiber may be employed as the light guide member 61 as shown in FIG. 20. In addition, the light guide member 61 may be arranged below a position through which the paper 6 passes (an upper position in FIGS. 18A, 18B, 19A and 19B) as shown in FIGS. 18A, 18B, 19A and 19B, or above the position as shown in FIG. 20. (FIGS. 18B and 19B are views which depict FIGS. 18A and 19A from the arrow A direction, respectively.)

The image forming apparatus has been explained while taking the electrophotographic image forming apparatus as an example. However, the present invention is not limited to the electrophotographic image forming apparatus. As a printing method of the apparatus, various methods such as an inkjet method, a sublimation-type heat transfer method, a silver salt photographic method, a direct thermal recording method, and melting type thermal recording method can be used.

According to the first aspect of the present invention, the characteristic of the medium which cannot be determined unless two pieces of information, the transmittance and the reflectance of the medium are detected can be determined, and the predetermined control can be executed appropriately.

According to the second aspect of the present invention, the thickness of the medium which cannot be determined unless two pieces of information, the transmittance and the reflectance of the medium are detected can be determined, and the predetermined control can be executed appropriately.

According to the third aspect of the present invention, the light emitting element and the light receiving element can serve as a sensor that detects whether each of the mediums, which are normally arranged at respective locations on the feed path, is present. Therefore, a manufacturing cost of the image forming apparatus can be reduced.

According to the fourth aspect of the present invention, not only the thickness of the medium can be determined but also the color of the medium can be determined by the reflected light receiving element.

According to the fifth aspect of the present invention, even the medium having a high light transmittance can be measured by changing the light quantity considering that the transmittance of the medium greatly differs according to the type of the medium. In addition, a region low in transmittance can be accurately measured while suppressing a noise.

According to the sixth aspect of the present invention, since the detection is performed on a single medium using a plurality of light quantities, a measurement can be carried out in accordance with various types of mediums, irrespective of a magnitude of the light transmittance.

According to the seventh and the eighth aspects of the present invention, the outputs are corrected, whereby an accurate measurement can be carried out in accordance with a fluctuation in components of the respective elements and the environmental change such as the temperature change.

According to the ninth aspect of the present invention, even if the medium is not present, a light emitted from the light emitting element can be caused to stably incident on the reflected light receiving element.

According to the tenth aspect of the present invention, the image forming operation, e.g., transfer, fixing conditions, and feeding of the paper on the feed path, can be appropriately controlled based on the information such as the detected thickness of the medium.

According to the eleventh aspect of the present invention, the information on the detected thickness of the medium is notified to the user. Therefore, the user can set image forming operation conditions by manual operation.

According to the twelfth aspect of the present invention, when the image of the original is read and image formation is performed, the characteristic of the medium which cannot be determined unless the two pieces of information, i.e., the transmittance and the reflectance are detected can be determined, and the predetermined control can be, therefore, appropriately executed.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus comprising:

a printer engine configured to form an image on a medium;

a supply unit configured to supply the medium to the printer engine through a feed path;

a light emitting element configured to emit light onto the medium at a predetermined position on the feed path;

a transmitted light receiving element configured to receive transmitted light of the light emitted by the light emitting element which is transmitted through the medium;

a reflected light receiving element configured to receive reflected light of the light emitted by the light emitting element which is reflected by the medium;

a detecting unit which executes a detection through the emission of light and the reception of transmitted light and reflected light;

a first determining unit which determines a characteristic of the medium based on detection signals output by the transmitted light receiving element and the reflected light receiving element as a result of the detection;

a control unit which executes a predetermined control in the image forming apparatus based on the characteristic determined by the first determining unit;

a second determining unit configured to determine whether the medium is present based on one of the detection signals output by the transmitted light receiving element and the reflected light receiving element; and a correcting unit configured to correct an output of at least one of the light emitting element, the transmitted light receiving element, and the reflected light receiving element output as a result of the detection, based on an output of one of the transmitted light receiving element output and reflected light receiving element output, when the light is emitted by the light emitting element while the medium is not present.

2. The image forming apparatus according to claim 1, wherein the first determining unit determines a thickness of the medium as the characteristic.

3. The image forming apparatus according to claim 1, wherein the first determining unit is configured to determine a color of the medium as the characteristic based on the detection signal output by the reflected light receiving element.

4. The image forming apparatus according to claim 1, wherein the detecting unit is configured to switch a quantity of the light emitted by the light emitting element between a plurality of quantities.

5. The image forming apparatus according to claim 4, wherein the detecting unit is configured to execute the detection a plurality of times on the same medium by switching the quantity of the light.

6. The image forming apparatus according to claim 1, further comprising:

a light guide member configured to guide the light emitted by the light emitting element when the medium is not present to the reflected light receiving element.

7. The image forming apparatus according to claim 1, wherein the control unit is configured to control an image forming operation of the image forming apparatus as the predetermined control.

8. The image forming apparatus according to claim 1, wherein the control unit is configured to notify a user of information related to the characteristic as the predetermined control.

9. The image forming apparatus according to claim 1, further comprising:

a scanner configured to read the image from an original, wherein the printer engine is configured to form the image based on the image read by the scanner.

* * * * *